US006638181B1

(12) United States Patent
Norman, III

(10) Patent No.: US 6,638,181 B1
(45) Date of Patent: Oct. 28, 2003

(54) GOLF PUTTER HEAD

(76) Inventor: Jerry L. Norman, III, 158 Lakeside Dr., Buena Park, CA (US) 90621-5665

( * ) Notice: Subject to any disclaimer, the term of this patent is extended or adjusted under 35 U.S.C. 154(b) by 0 days.

(21) Appl. No.: 10/087,343

(22) Filed: Feb. 28, 2002

Related U.S. Application Data

(60) Provisional application No. 60/273,222, filed on Mar. 5, 2001.

(51) Int. Cl.[7] ..... A63B 53/04

(52) U.S. Cl. ..... 473/330; 473/341; 473/342

(58) Field of Search ..... 473/330, 341, 473/342, 331, 340, 313, 252, 334, 339, 307

(56) References Cited

U.S. PATENT DOCUMENTS 2,163,091 A * 6/1939 Held ..... 473/338
2,198,981 A * 4/1940 Sullivan ..... 473/338
4,655,459 A * 4/1987 Antonious ..... 473/338
5,385,348 A * 1/1995 Wargo ..... 473/338
5,388,827 A * 2/1995 Reynolds, Jr. ..... 473/306
5,533,725 A * 7/1996 Reynolds, Jr. ..... 473/307
5,571,053 A * 11/1996 Lane ..... 473/336
5,632,694 A * 5/1997 Lee ..... 473/336
5,746,664 A * 5/1998 Reynolds, Jr. ..... 473/252
6,179,727 B1 * 1/2001 Giordano ..... 473/330
6,306,048 B1 * 10/2001 McCabe et al. ..... 473/333

* cited by examiner

*Primary Examiner*—Paul T. Sewell
*Assistant Examiner*—Tom Duong
(74) *Attorney, Agent, or Firm*—Charles H. Thomas

(57) ABSTRACT

A golf club putter head has a unique, geometric configuration that is advantageous for achieving consistently accurate putting shots. The golf putter head of the invention is characterized by a convex complexly contoured ball impact surface and by a high bridge that extends lengthwise at the face of the putter to join the heel and toe. The end extremities of both the putter heel and toe are curved with a complex and unique geometric curvature. Vertical, tapped, chamfered bores are defined in both the putter toe and the putter heel to receive externally threaded inserts. The inserts may be hollow so as to accommodate a variable number of disc-shaped weights, the number of which is individually selected by each golfer. Alternatively, the inserts may be solid structures of a weight suitable to the individual golfer.

16 Claims, 8 Drawing Sheets

GOLF PUTTER HEAD

This application claims the benefit of U.S. Provisional Application No. 60/273,222 filed Mar. 5, 2001.

BACKGROUND OF THE INVENTION

1. Field of the Invention

The present invention relates to a new and improved configuration for a golf club putter head to improve the putting performance of a golfer executing strokes with a putter.

2. Description of the Prior Art

The importance of proficiency in putting in playing the game of golf is widely recognized among golf professionals and talented amateur golfers as well. While powerful and accurate approach shots that allow a golfer to advance his or her golf ball to the golf green with a minimal number of strokes are undeniably important assets in the game of golf, any advantage that a golfer may achieve with good approach shots can be easily lost with inaccurate putting. For this reason many different styles of golf putter heads and putter shafts have been devised to attempt to improve a golfer's performance in putting. However, an accurate and consistent putting game remains one of the most elusive challenges encountered by golfers in playing the game of golf.

SUMMARY OF THE INVENTION

The present invention is an improved golf club putter head that has unique design characteristics that enhance the accuracy and consistency of putting in the game of golf. The putter head of the invention, unlike conventional golf putter heads, is constructed with complex convex rounded surfaces on its ball impact face and at its ends and with a high bridge above and across its face. The uniquely curved surfaces on the putter head allow the golfer to exert greater control over a putt and improve the swing of the putter. One very significant advantage is that, due to the convex curvature on the ball impact face, the golf ball will not jump upon impact, but rather will begin to roll immediately toward the cup.

Also, the putter head of the invention includes a pair of vertical, internally tapped chamfered bores extending downwardly from the top of the head and into the putter structure at both ends of the club head. The bores are normal to the flat top surfaces of the putter head heel and toe. The edges of the bores at these surfaces are chamfered at an angle of 39° 57.6" relative to horizontal at both ends of the putter head. These bores receive externally threaded brass or tungsten insert plugs that screw down into the structure of the putter head. These inserts aid in balancing the putter head so that shots using the putter will not steer to the left or to the right.

The golf putter head of the invention has a vertical hosel socket that extends downwardly into the raised bridge at a location offset from the center of the club as measured between the extremities of the heel and toe along a longitudinal axis extending therebetween. This socket receives the lower extremity of the golf putter shaft and will be customized to the left or the right side for either left-handed or right-handed golfers.

In one broad aspect the present invention may be considered to a golf putter head formed with a sole, a heel, a toe, and a ball impact face, and in which the ball impact face has a convex, forwardly facing surface curvature. Preferably the heel and toe both have opposing, mirror image, convex outwardly facing end surface configurations with a convex curvature considered both in a horizontal plane and in a vertical plane passing through the center of the structure of the golf putter head and bisecting the heel and toe. That is, the end surfaces of the heel and toe are curved convex outwardly in a horizontal plane and also convex outwardly in a vertical plane perpendicular to the desired direction of travel of the golf ball. The ball impact surface preferably has a central portion, an upper portion, and a lower portion with different radii of curvatures. The radius of curvature of the central portion is approximately half the radius of curvature of the upper portion and slightly less than half the radius of curvature of the lower portion considered in a vertically bisecting plane passing through the center of the ball impact face. The radius of curvature of the central portion of the ball impact face is preferably about 0.783 inches, while the radius of curvature of the upper portion of the ball impact face is preferably about 1.573 inches. The radius of curvature of the lower portion of the ball impact face is about 1.888 inches.

In another broad aspect the invention may be considered to a golf ball putter head having a body formed with a sole, a heel, a toe, a ball impact face, and a hosel socket. The heel and toe have convex curved outwardly and oppositely facing end surfaces and the ball impact face is a convex, curved, forwardly facing surface. A low shelf is defined on the putter head directly behind the bridge.

The body is preferably further comprised of a bridge located above and extending between the heel and the toe. The bridge has a convex curved forwardly facing surface that forms the upper portion of the ball impact face.

The heel and the toe are preferably both formed with upper surfaces in which vertically aligned cavities are aligned. Separate inserts are provided and are releaseably engageable in each of the cavities. A plurality of weights may also be provided. These weights are selectably positionable in each of the vertically aligned cavities. The inserts capture and hold the weights placed in the cavities in predetermined positions therewithin.

In still another broad aspect the invention may be considered to be a golf ball putter head having a body formed of a heel, a toe, a ball impact face, a hosel socket, and an elevated bridge with a flat, horizontal upper surface extending across the upper portion of the ball impact face and above and between the heel and the toe. The ball impact face is curved convex forward.

The invention may be described with greater clarity and particularity by reference to the accompanying drawings.

DESCRIPTION OF THE EMBODIMENT

Figure 1:
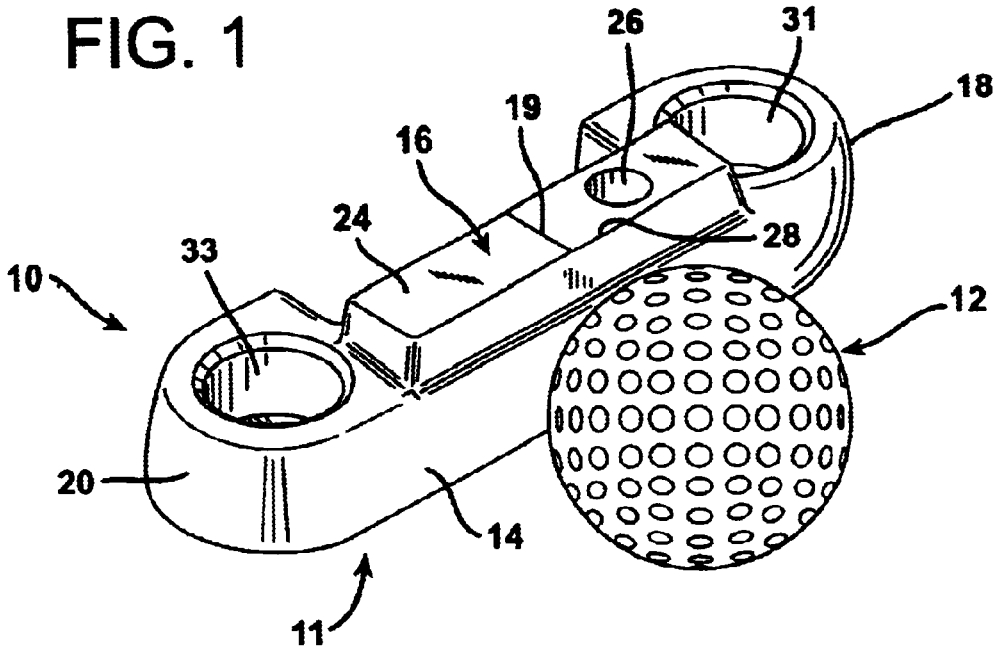
FIG. 1 is a perspective view of a golf club head according to the invention shown striking a golf ball at the proper point of impact on the putter head face.

FIG. 1 illustrates a golf putter head generally at 10 constructed of an aluminum body 11 according to the present invention. The golf club putter head 10 is shown relative to a spherical golf ball 12 with the golf ball 12 shown in the location in which it is impacted by the putter head 10 at the proper point of impact, that is, the "sweet spot", on the ball impact face 14.

Figure 4:
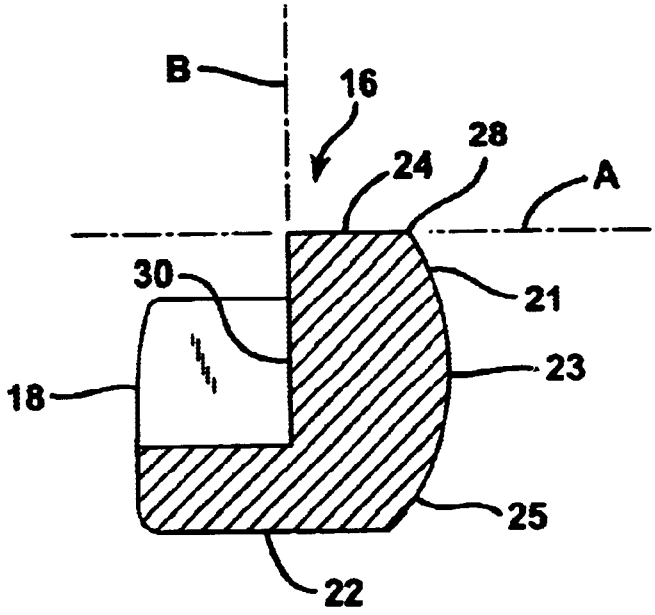
FIG. 4 is a sectional elevational view taken along the lines 4–4 of FIG. 3.
Figure 5:
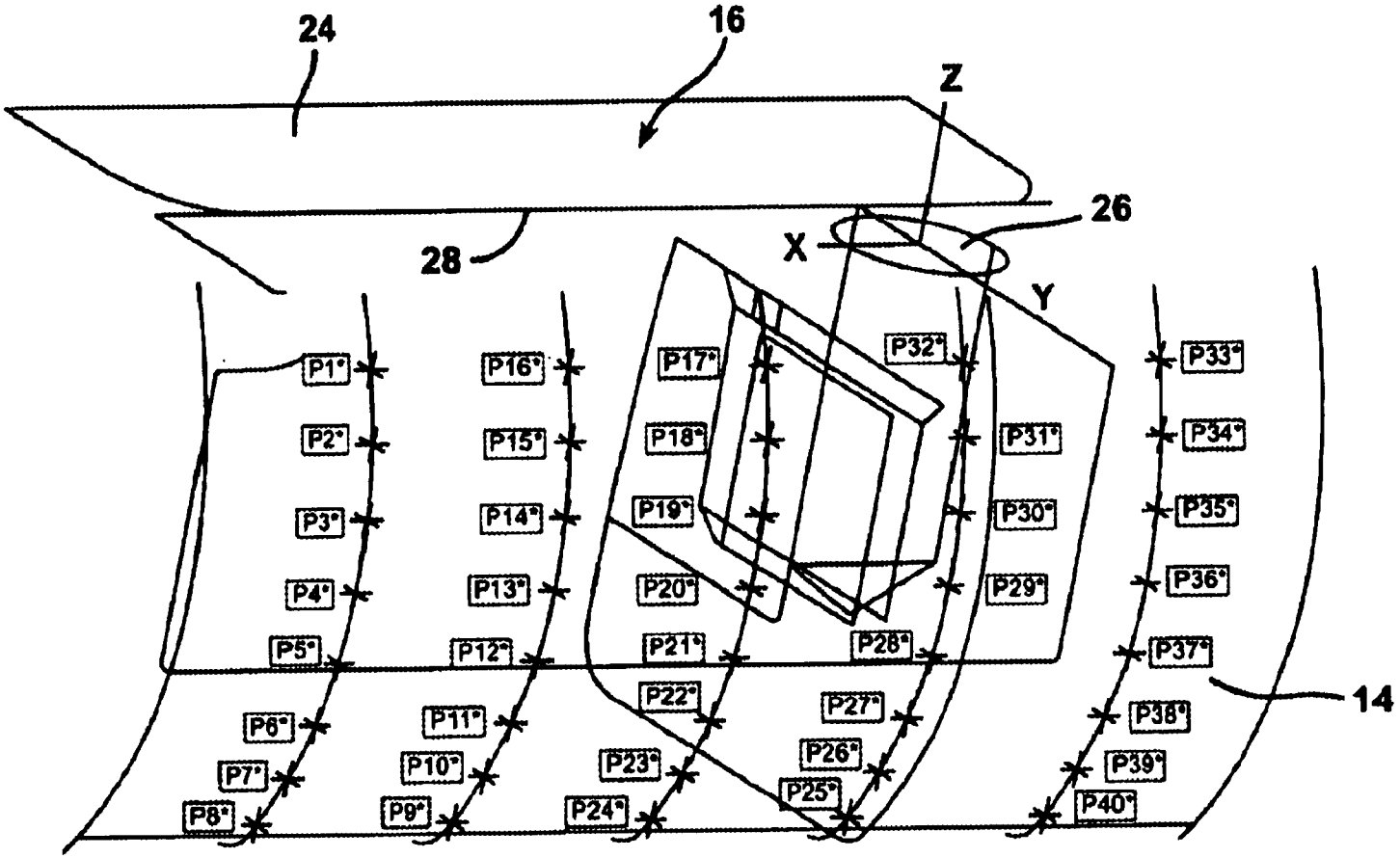
FIG. 5 is a detailed perspective diagram of the convex, curved, ball impact surface that is illustrated in side sectional elevation in FIG. 4, with reference points shown and labeled.

As best shown in FIGS. 4 and 5, the ball impact face 14 is a curved surface that is outwardly convex and which curves upwardly and outwardly from the putter head sole 22 to the top of a bridge 16. The ball impact face 14 extends considerably higher than the normal ball impact face of a conventional putter head due to the relatively great height of the bridge 16 that extends between the inboard heel 18 and the outboard toe 20 of the putter head 10.

Figure 2:
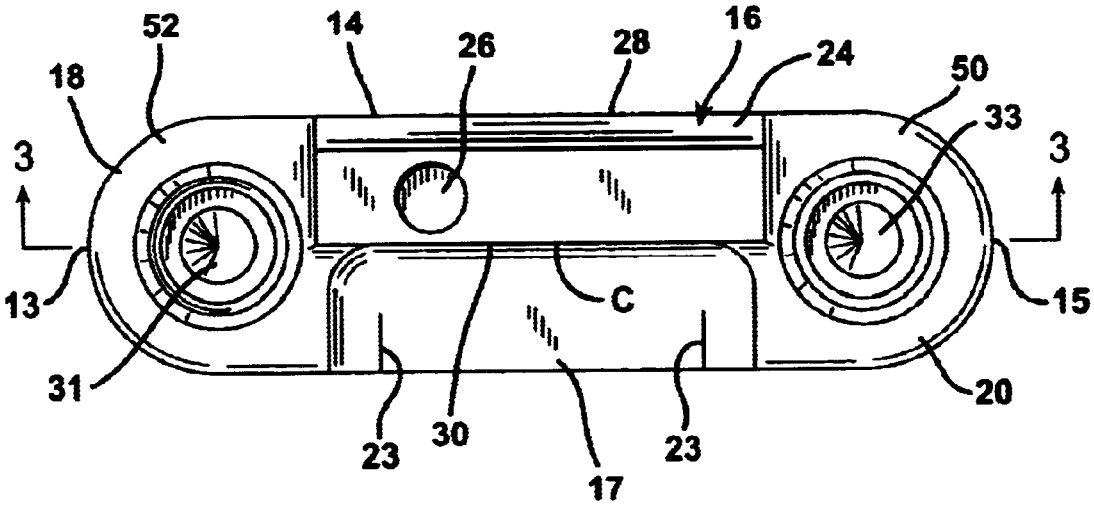
FIG. 2 is a top plan view of the golf putter head of FIG. 1.
Figure 3:
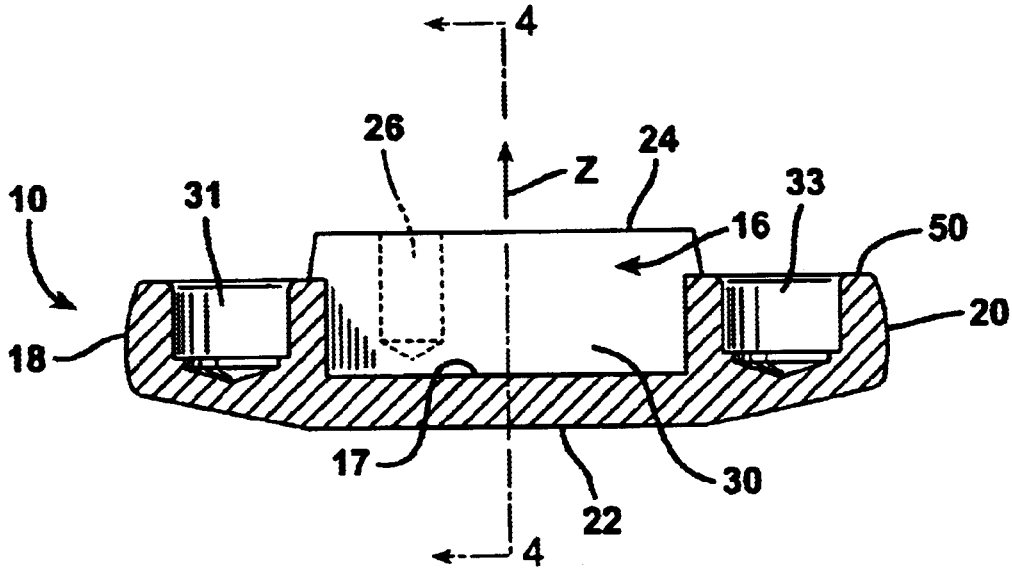
FIG. 3 is a rear elevational view of the putter head shown in FIG. 2.

The extremities of the heel 18 and toe 20 define opposing points 13 and 15, respectively, on the body 11 having the greatest distance of separation therebetween. The extreme inboard point 13 on the heel 18 and the extreme outboard point 15 on the toe 20 define the extremities of the body 11 most remote from each other. The center of the body 11 is indicated at C and is located midway between the remote extremities 13 and 15. As shown in FIG. 2, the length of the putter head, as measured by the linear distance between the extremities 13 and 15 of the heel 18 and the toe 20, respectively, along the line 3—3, is 4.87 inches. As shown in FIG. 3, the height of the bridge 16 that extends vertically upwardly from the sole 22 of the club head 10 is 1.278 inches at the center of the sole 22. A fore and aft guide line 19 is provided at the center of the upper surface 24 of the bridge 16. Two guide lines 23 are provided on the flat, horizontal surface 25 located on the deep shelf 17 defined behind the bridge 16. The guide lines 19 and 23 assist golfers when aiming the golf ball 12 toward the cup.

The putter head 10 is equipped with a vertical, cylindrical hosel socket 26 that extends down into the flat, horizontal upper surface 24 of the bridge 16 to a full diameter depth of 0.710 inches. The hosel socket 26 is located in the body 11 of the golf putter head between the remote extremities 13 and 15 of the heel 18 and toe 20, respectively. The hosel socket 26 is located closer to the heel 18 than the toe 20. The hosel socket 26 is preferably located between the center C of the body 11 and heel 18 and is preferably centered at a distance of about 0.600 inches from the fore and aft guide-line 19 at the center of the upper surface 24 of the bridge 16. The hosel socket 26 is located midway between the top upper edge 28 of the bridge 16 and the vertical, flat, back surface 30 of the bridge 16 to receive the lower extremity of a conventional golf putter shaft (not shown). The hosel socket 26 is located 0.600 inches from the longitudinal center of the length of the bridge 16, as measured in a direction parallel to the maximum distance between the heel 18 and toe 20. The bridge 16 extends between and above the heel 18 and the toe 20. The flat back surface 30 of the bridge 16 extends downwardly a distance of 0.931 inches where it intersects a flat, horizontal shelf 17 that has a width extending between the vertical, mutually facing surfaces of the heel 18 and toe 20. The width of the shelf 17 as viewed in FIGS. 2 and 3 is 2.311 inches.

Figure 8:
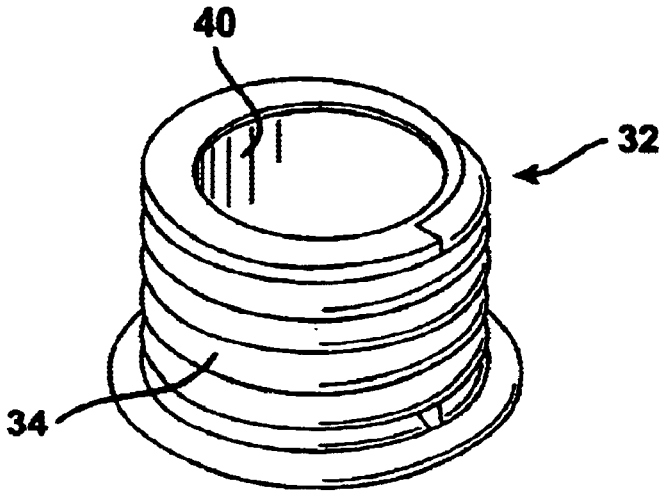
FIG. 8 is a perspective view of a brass-tungsten insert employed in the putter head of FIG. 1, shown inverted.
Figure 9:
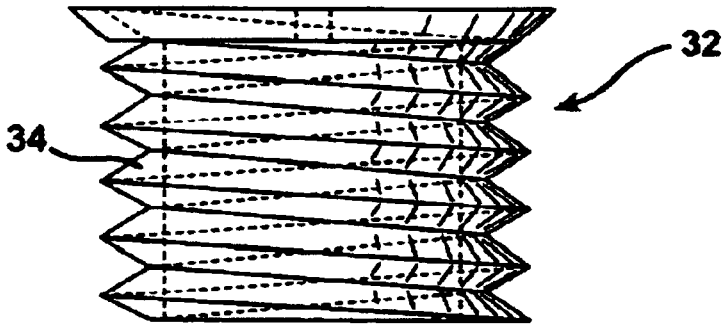
FIG. 9 is a side elevational view of the insert shown in FIG. 8 in an upright position.

Vertical wells are formed in the flat upper surfaces 50 and 52 of the heel 18 and toe 20 of the body 11. The wells are weight-receiving enclosures formed by internally tapped bores 31 and 33 which are drilled into the body structure 11 of the golf club putter head 10 to receive two inserts 32 of the type illustrated in FIGS. 8–13. The bores 31 and 33 are oriented normal to the flat, horizontal surfaces 50 and 52 and the bore openings are chamfered at an angle of 39° 57.6" relative to horizontal. A separate insert 32 is provided for each of the vertical bores 31 and 33, located respectively in the heel 18 and toe 20 of the putter head 10. Each of the inserts 32 has a flat upper, exposed surface 0.875 inches in diameter, is three-quarters of an inch in outer pitch diameter, and is externally threaded at ten threads per inch UNC as indicated at 34 in FIGS. 8 and 9. The inserts 32 have a threaded length of 0.466 inches and are threaded down into each of the internally tapped bores 31 and 33.

Figure 12:
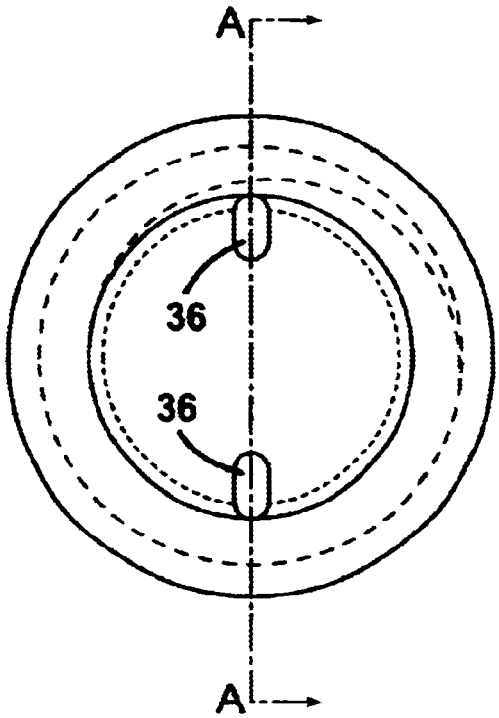
FIG. 12 is an enlarged top plan view showing greater detail of the insert shown in FIG. 8.
Figure 11:
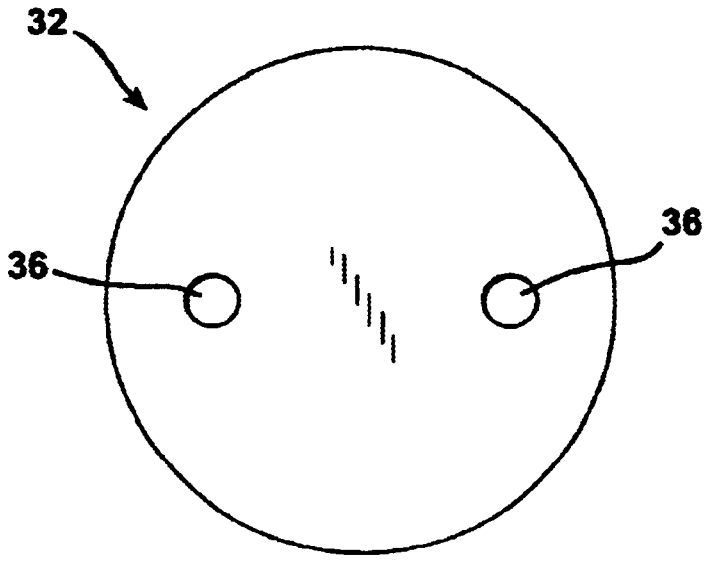
FIG. 11 is a top plan view of the insert shown in FIG. 8.
Figure 10:
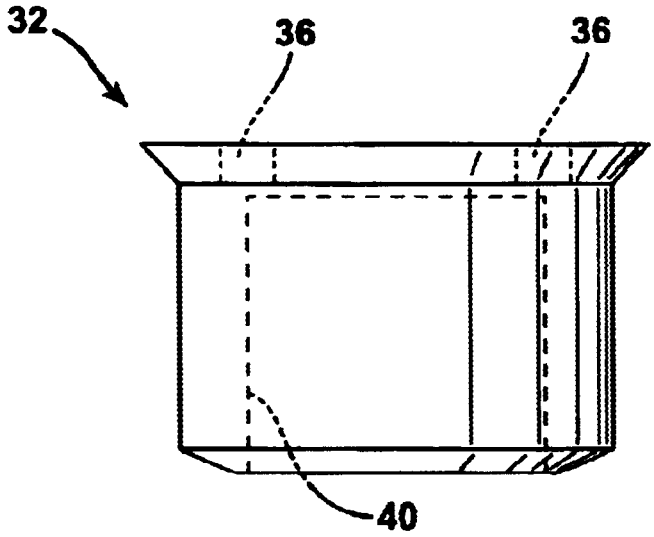
FIG. 10 is another side elevational view of the insert of FIG. 8 showing the hidden portions thereof.

There are a pair of oblong, wrench-engaging recesses 36, each 0.087 inches in length and 0.060 inches in depth, defined in the flat, upper surface of each of the inserts 32, as illustrated in FIGS. 11–12. The recesses 36 can have different shapes. The recesses 36 are spaced to receive the prongs of a wrench that is used to screw and unscrew the inserts 32 from the internally tapped bores 31 and 33.

Figure 13:
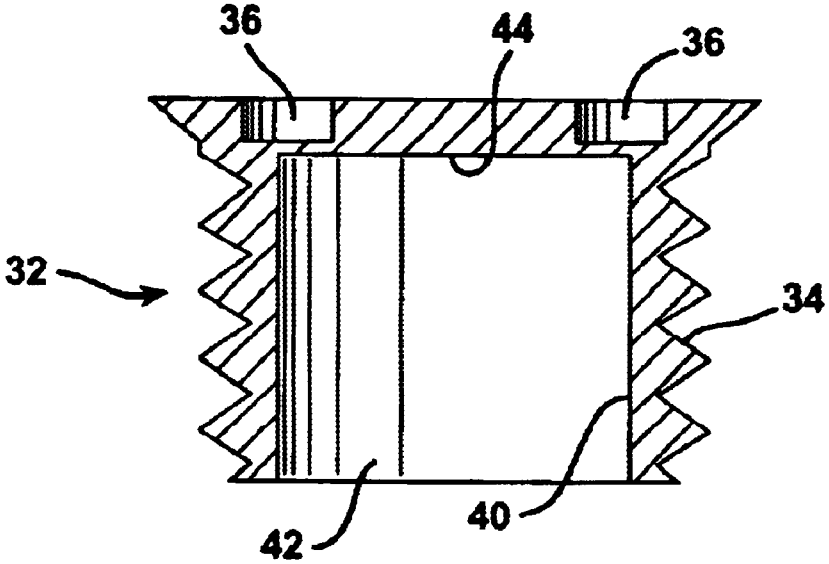
FIG. 13 is a side sectional view of the insert taken along the lines A—A of FIG. 12.

Each of the threaded inserts 32 has a cylindrical, hollow chamber 40 with a downwardly opening mouth 42 defined at the center of its structure, as best illustrated in FIG. 13. The cylindrical cavity 40 is 0.466 inches in depth and has a blind face 44 that is 0.520 inches in diameter opposite the downwardly opening mouth 42. The cavities 40 are designed to receive and accommodate with a close tolerance a disc-shaped weight or plurality of weights which the golfer may elect to place therein. The number of the weights, and thus the total weight within each of the bores 31 and 33, is within the discretion of each individual golfer. The golfer merely selects the appropriate number of disc-shaped weights, drops them down into the center of the appropriate bores 31 and/or 33, and then threadably engages the inserts 32 into the internally tapped bores 31 and/or 33 so that the wall thickness of the threaded insert 32 coaxially surrounds the disc-shaped weights located therewithin. Instead of hollow inserts 32, the inserts can be formed as solid structures without a cavity of any significant depth from brass, tungsten, or other suitable metals.

The curvature of the rounded ends of the heel 18 and toe 20 of the golf club 10 is quite important. The curvatures of the heel 18 and toe 20 are identical so that the detailed views of the toe 20, illustrated in FIGS. 6 and 7, with reference to Table A, define the curvature of both the toe 20 and the heel 18. The curvature of the heel 18 is the mirror image of the curvature of the toe 20 illustrated in FIGS. 6 and 7.

TABLE A

| POINT | X DIM. | Y DIM. | Z DIM. |
|---|---|---|---|
| PT1 | 1.4156 | −.0653 | −.1823 |
| PT2 | 2.0200 | −.5141 | −.1976 |
| PT3 | 2.322 | −.0059 | −.1976 |

TABLE A-continued

| POINT | X DIM. | Y DIM. | Z DIM. |
|---|---|---|---|
| PT4 | 2.0219 | .4990 | −.1976 |
| PT5 | 1.4156 | .6088 | −.1823 |
| PT6 | 1.4156 | −.6531 | −.4970 |
| PT7 | 2.0753 | −.5475 | −.4970 |
| PT8 | 2.4081 | .0083 | −.4970 |
| PT9 | 2.0783 | .5572 | −.4970 |
| PT10 | 1.4156 | .6852 | −.4970 |
| PT11 | 1.4156 | −.6783 | −.8153 |
| PT12 | 2.0908 | −.5771 | −.8153 |
| PT13 | 2.4342 | −.0111 | −.8153 |
| PT14 | 2.0943 | .5465 | −.8153 |
| PT15 | 1.4156 | .6705 | −.8153 |
| PT16 | 1.4156 | −.6807 | −1.1340 |
| PT17 | 2.0467 | −.5897 | −1.1340 |
| PT18 | 2.3842 | −.0689 | −1.1340 |
| PT19 | 2.0547 | .4339 | −1.1340 |
| PT20 | 1.4156 | .5214 | −1.1340 |
| PT21 | 1.4156 | −.6630 | −1.4439 |
| PT22 | 1.9166 | −.5679 | −1.4439 |
| PT23 | 2.2118 | −.1533 | −1.4439 |
| PT24 | 1.9346 | .2046 | −1.4439 |
| PT25 | 1.4156 | .1888 | −1.4439 |

Figure 6:
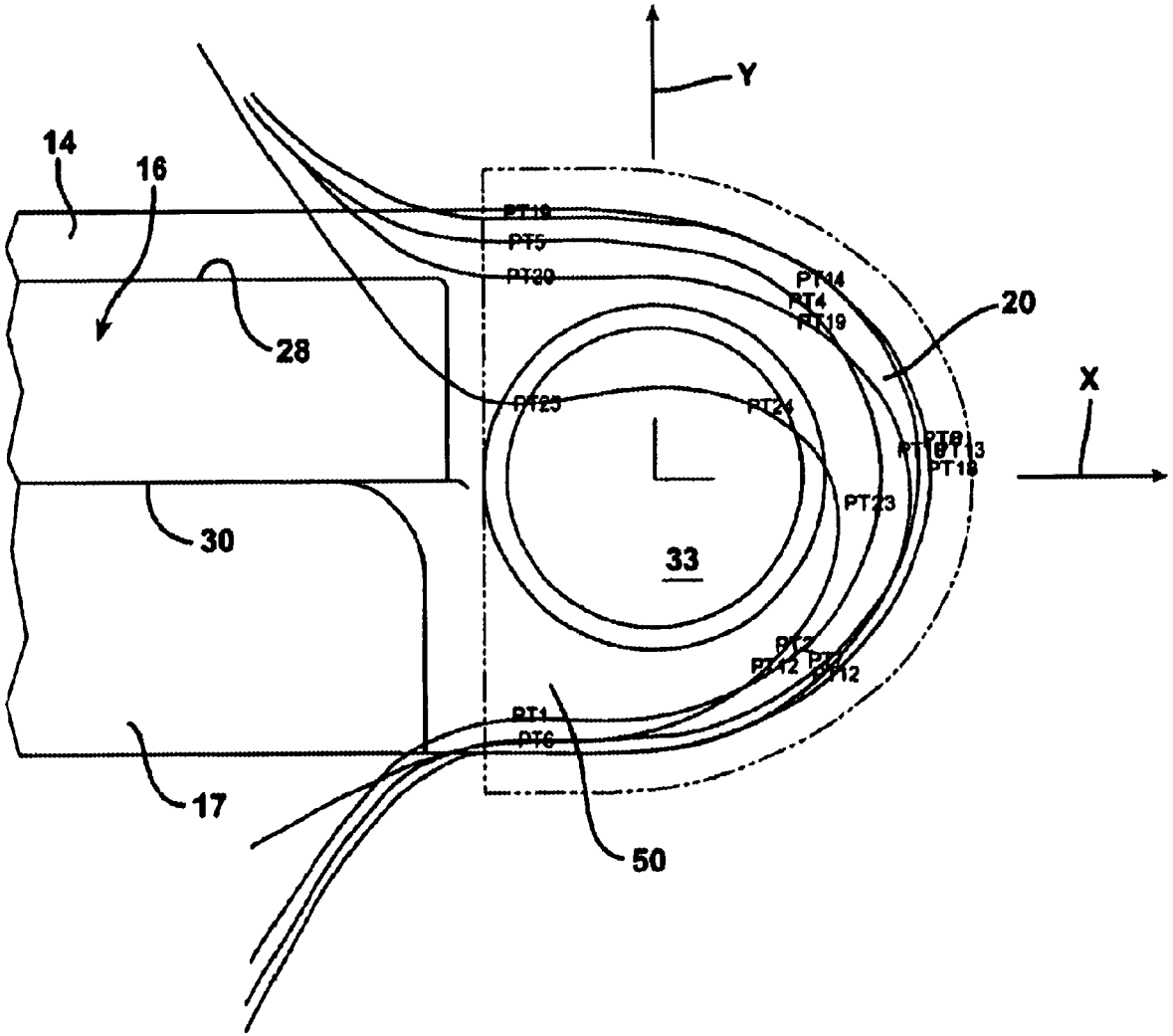
FIG. 6 is a top plan detail of the putter toe at the right hand end of the golf putter head shown in FIG. 2, with reference points labeled on the complex, curved surface thereof.
Figure 7:
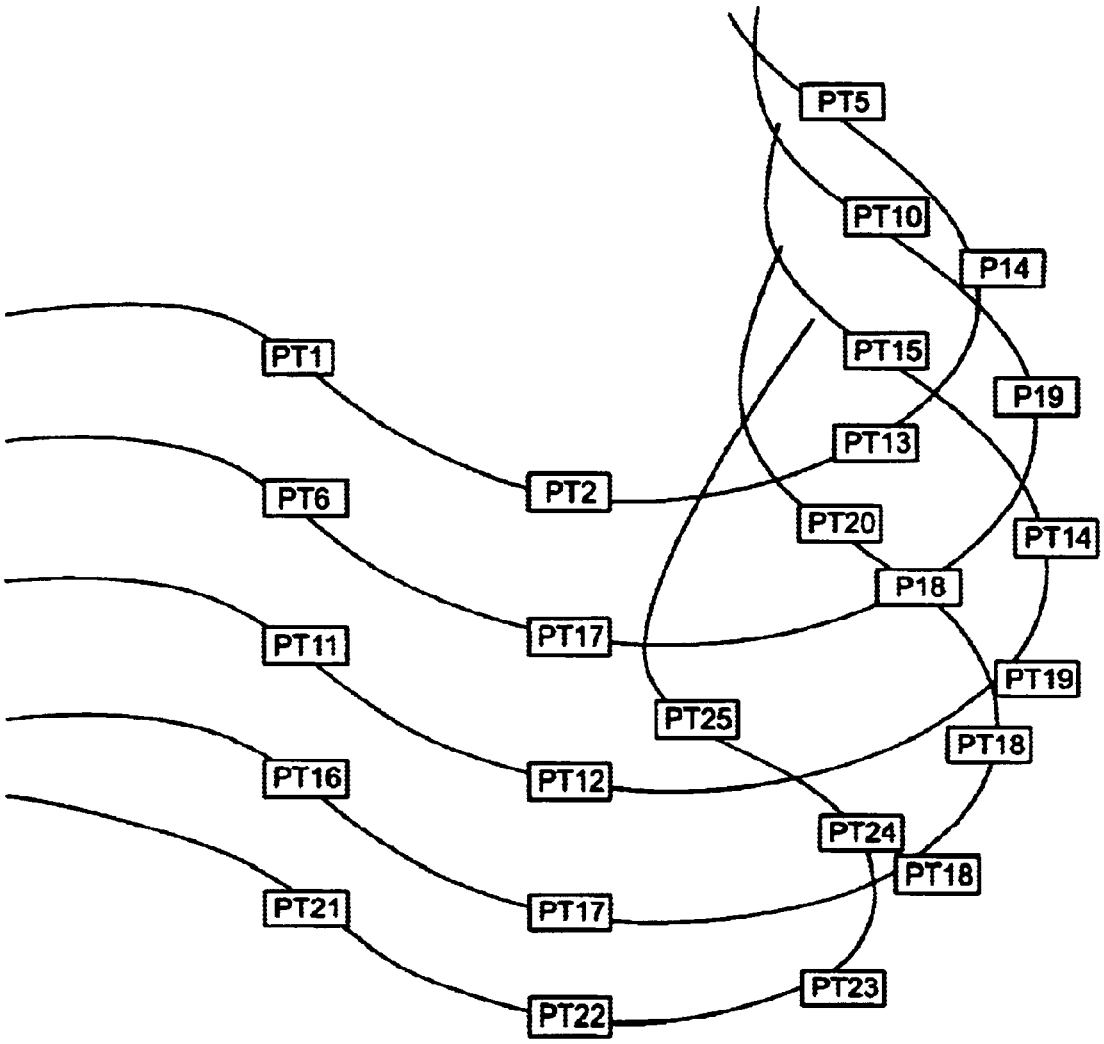
FIG. 7 is a diagram showing the reference points in perspective of the curved end surface illustrated in FIG. 6.

As shown in FIGS. 6 and 7, the curved surfaces of the ends of the heel 18 and toe 20 may be defined utilizing a series of reference points labeled PT1 through PT25. The distances indicated in Table A are the distances of the points PT1 through PT25, shown in FIGS. 6 and 7, from axes is an orthogonal coordinate system defined by mutually perpendicular X, Y and Z directions. The point of origin for the reference points PT1 through PT25 shown in FIGS. 6 and 7 and in Table A lies on the vertical axis labeled Z in FIG. 3. The axis Z is a vertical axis located midway between the vertical axis of the internally threaded bore 33 in the putter head toe 20 and the vertical axis of the internally threaded bore 31 in the putter head heel 18. The dimensions of the reference points PT1 through PT25 in the Z direction in Table A represents the vertical distance of each point below the plane of the top planar, horizontal surfaces 50 and 52 of the putter head toe 20 and putter head heel 18, respectively. The surfaces 50 and 52 lie in the same horizontal plane, as is evident from FIG. 3.

The Y dimension in Table A represents the distance in the direction indicated by the directional arrow Y in FIG. 6 of each point PT1 through PT25 relative to the vertical plane that passes through the Z axis shown in FIG. 3 and which is coplanar with the back vertical surface 30 of the bridge 16. A positive number of the Y dimension in Table A indicates a distance foreword of the back surface 30 in a direction toward the ball impact face 14. A negative number for the Y dimension specified in Table A indicates that the point lies behind the back face 30 and in a direction therefrom opposite that indicated by the directional arrow Y in FIG. 6.

The X dimension in Table A indicates the horizontal distance of each reference point from the Z axis in the direction indicated by the directional arrow labeled X in FIG. 6 from a plane passing through the Z axis at the longitudinal center of the putter head 10 and perpendicular to the plane of the back face 30 of the bridge 16. The X dimension is measured from that plane toward the longitudinal extremity of either the heel 18 or the toe 20 of the putter head 10.

The curvature of the ball impact face 14 of the putter head 10 is a key aspect of the invention. The curvature of the ball impact face 14 provides greater control of the ball 12 during a putt and imparts a roll to the golf ball 12 while avoiding a tilt or a jump of the ball 12 upon impact with the ball impact face 14 of the putter head 10. The contour of the ball impact face 14 is illustrated at the center of the ball impact face 14 in FIG. 4.

The ball impact face 14 may be considered to be formed in three portions, an upper portion 21, a central portion 23, and a lower portion 25. The upper portion 21 of the ball impact face 14 is formed by the convex forwardly facing surface of the bridge 16 that extends above and between the heel 18 and the toe 20 of the golf club head 10. The radius of curvature of the upper portion 21 of the golf ball impact face 14 is preferably 1.573 inches and extends upwardly from the plane of the flat upper surfaces 50 and 52 of the heel 18 and toe 20. The central portion 23 of the ball impact face 14 has a radius of curvature of approximately half that of the upper portion 21. More specifically, the central portion 23 of the ball impact face 14 has a convex forwardly facing radius of curvature which is preferably 0.783 inches. The central portion 23 extends from the plane of the upper surfaces 52 of the heel 18 and toe 20 down to the plane of the shelf 17 behind the bridge 16. The radius of curvature of the lower portion 25 of the ball impact face 14 is preferably 1.888 inches. The lower portion 25 of the ball impact face 14 extends from the plane of the shelf 17 down to flat, horizontal sole 22. The surface profile of the ball impact face 14 is more completely illustrated in the diagram of FIG. 5 and by Table B.

TABLE B

| POINT | X DIM. | Y DIM. | Z DIM. |
|---|---|---|---|
| PT1 | 1.5877 | 0.336 | −0.1417 |
| PT2 | 1.5877 | 0.3881 | −0.2919 |
| PT3 | 1.5877 | 0.4238 | −0.447 |
| PT4 | 1.5877 | 0.4405 | −0.6051 |
| PT5 | 1.5877 | 0.4281 | −0.7635 |
| PT6 | 1.5877 | 0.3844 | −0.9164 |
| PT7 | 1.5877 | 0.3151 | −1.0595 |
| PT8 | 1.5877 | 0.2283 | −1.1928 |
| PT9 | 1.0837 | 0.2281 | −1.1931 |
| PT10 | 1.0837 | 0.315 | −1.0597 |
| PT11 | 1.0837 | 0.3844 | −0.9166 |
| PT12 | 1.0837 | 0.4279 | −0.7637 |
| PT13 | 1.0837 | 0.4405 | −0.6053 |
| PT14 | 1.0837 | 0.4239 | −0.4471 |
| PT15 | 1.0837 | 0.3881 | −0.292 |
| PT16 | 1.0837 | 0.336 | −0.1418 |
| PT17 | 0.5797 | 0.336 | −0.1417 |
| PT18 | 0.5797 | 0.3882 | −0.2919 |
| PT19 | 0.5797 | 0.4238 | −0.447 |
| PT20 | 0.5797 | 0.4404 | −0.6051 |
| PT21 | 0.5797 | 0.4281 | −0.7635 |
| PT22 | 0.5797 | 0.3843 | −0.9163 |
| PT23 | 0.5797 | 0.3151 | −1.0594 |
| PT24 | 0.5797 | 0.2283 | −1.1928 |
| PT25 | 0.0757 | 0.2282 | −1.193 |
| PT26 | 0.0757 | 0.315 | −1.0596 |
| PT27 | 0.0757 | 0.3843 | −0.9165 |
| PT28 | 0.0757 | 0.4282 | −0.7637 |
| PT29 | 0.0757 | 0.4404 | −0.6052 |
| PT30 | 0.0757 | 0.4237 | −0.4471 |
| PT31 | 0.0757 | 0.3882 | −0.292 |
| PT32 | 0.0757 | 0.336 | −0.1417 |
| PT33 | −0.4284 | 0.3361 | −0.1417 |
| PT34 | −0.4284 | 0.3882 | −0.2919 |
| PT35 | −0.4284 | 0.4237 | −0.447 |
| PT36 | −0.4284 | 0.4404 | −0.6052 |
| PT37 | −0.4284 | 0.4282 | −0.7636 |
| PT38 | −0.4284 | 0.3843 | −0.9164 |
| PT39 | −0.4284 | 0.315 | −0.1586 |
| PT40 | −0.4284 | 0.2282 | −1.193 |

The perspective diagram of FIG. 5 illustrates a series of reference points P1 through P40, the dimensions of which in an orthogonal coordinate system are tabulated in Table B.

The Z dimension indicated in Table B is the vertical distance along the Z axis shown in FIG. 5 from a reference plane A, shown in FIG. 4, which is the horizontal plane in which the top surface 24 of the bridge 16 lies. The Z axis is the axis of the hosel bore 26 that receives the lower extremity of the putter shaft. The X dimensions in Table B are the horizontal distances of reference points P1 through P40 in a horizontal direction parallel to the vertical plane of the back face 30 of the bridge 16 as measured from a vertical plane perpendicular to the vertical plane containing the back face 30 and passing through the Z axis of the shaft hosel socket 26. That is, the points P33 through P40 indicated in FIG. 5 have a negative X dimension indicated in Table B because they are located toward the heel end of the putter head 10 relative to a vertical plane passing through the vertical axis Z of the shaft hosel socket 26 and perpendicular to the plane B and back face 30 shown in FIG. 4. The points P1 through P32 shown in FIG. 5 that have a positive dimension as shown in Table B are located in a direction toward the toe 20 from a plane perpendicular to the plane B shown in FIG. 4 and containing the Z axis of the hosel socket 26 shown in FIG. 5. The Y dimension in Table B is the horizontal distance of the reference point indicated from the plane B of the back face 30 of the bridge 16 in the direction of the golf ball 12 shown in FIG. 1. The ball impact face 14 is the smoothly curved surface on which all of the points P1 through P40 lie.

Undoubtedly, numerous variations and modifications of the invention will become readily apparent to those familiar with golf putter design. Accordingly, the scope of the invention should not be construed as limited to this specific embodiment depicted and described.

I claim:

1. A golf putter head comprising a body formed with a sole, a heel, a toe, and a ball impact face and said ball impact face has a convex, forwardly facing surface curvature and said heel and said toe both have opposing convex outwardly facing curved end surface configurations, and said end surface configurations of said toe and said heel are curved convex outwardly considered both in a horizontal plane parallel to said sole and in a vertical plane perpendicular to said sole and bisecting said heel and said toe, and wherein said body is further comprised of a bridge located above and extending between said heel and said toe and above said sole over a distance of about 1.278 inches, and said bridge has a convex, curved, forwardly facing surface that forms the upper portion of said ball impact face.

2. A golf putter head according to claim 1 further comprising separate vertical weight enclosures defined in each of said heel and said toe, and weights are provided for disposition in each of said weight enclosures.

3. A golf putter head according to claim 1 further comprising separate vertical weight enclosures defined in said heel and in said toe, and separate inserts releaseably engageable in said weight enclosures.

4. A golf putter head according to claim 1 further comprising a bridge that extends between and resides above said heel and said toe, and said bridge has a front surface that forms the upper portion of said ball impact face and which has a convex radius of curvature in a plane vertically bisecting said ball impact face of about 1.573 inches and beneath which said ball impact face has a central portion having a convex radius of curvature in said vertically bisecting plane of about 0.783 inches, and beneath which said ball impact face has a lower portion with a radius of curvature of about 1.888 inches in said vertically bisecting plane.

5. A golf putter head according to claim 2 wherein said weight enclosures are formed as internally tapped bores and further comprising externally threaded inserts removably engageable in said internally tapped bores.

6. A golf putter head according to claim 5 wherein said weight enclosures are tapped bores and said inserts are hollow externally threaded plugs engageable in said tapped bores, and further comprising a plurality of weights which may be selectively placed in said hollow plugs.

7. A golf ball putter head comprising a body formed with a flat, horizontal sole, a heel, a toe, a ball impact face, and a hosel socket, and said heel and toe have oppositely facing end surfaces, and said ball impact face is a convex, curved, forwardly facing surface and said end surfaces of said toe and said heel are both curved convex outwardly considered both in a horizontal plane parallel to said sole and in a vertical plane perpendicular to said sole and bisecting said heel and said toe, and wherein said body is further comprised of a bridge located above and extending between said heel and said toe and from said sole over a distance of about 1.278 inches, and said bridge has a convex, curved, forwardly facing surface that forms the upper portion of said ball impact face.

8. A golf putter head according to claim 2 wherein said ball impact face has a lower portion that is curved upwardly from said sole at a radius of curvature of about 1.888 inches, a central portion located directly above said lower portion and having a radius of curvature of about 0.783 inches, and an upper portion located directly above said central portion and having a radius of curvature of about 1.573 inches.

9. A golf putter head according to claim 7 wherein said heel and said toe are formed with upper surfaces into which vertically aligned cavities are defined, and further comprising separate inserts releaseably engageable in each of said cavities.

10. A golf putter head according to claim 7 wherein said heel and toe define extremities of said body remote from each other, and the center of said body is located midway between said remote extremities, and said hosel socket is located in said body between said center and said heel.

11. A golf putter head according to claim 9 further comprising a plurality of weights selectively positionable in each of said vertically aligned cavities and said inserts capture and hold weights placed in said cavities in predetermined positions therewithin.

12. A golf putter head according to claim 11 wherein said sole is a flat, horizontal surface and said heel and said toe are both formed with flat undersurfaces that are inclined upwardly and outwardly from said sole toward opposite ends of said body.

13. A golf putter head according to claim 12 wherein said undersurfaces of said heel and toe are both inclined at a uniform angle relative to said sole.

14. A golf ball putter head comprising a body formed with a heel, a toe, a ball impact face, a hosel socket, and an elevated bridge with a flat, horizontal upper surface extending across the upper portion of said ball impact face and above and between said heel and said toe, and said ball impact face is curved convex forward, wherein said heel and said toe both have end surfaces that are curved convex outwardly in opposite directions considered both in a horizontal plane and in a vertical plane passing through the center of said body and bisecting said heel and said toe, and said bridge forms the upper portion of said ball impact face and projects above said sole a distance of about 1.27 inches.

15. A golf ball putter head according to claim 14 wherein said ball impact face has a radius of curvature at its center of about 0.783 inches, a radius of curvature above its center of about 1.573 inches and a radius of curvature below its center of about 1.888 inches as measured in a plane bisecting said ball impact face, perpendicular to said upper surface of said bridge and with a desired direction of ball travel from said ball impact face.

16. A golf ball putter head according to claim 14 wherein weight-receiving enclosures are defined in said heel and said toe and a plurality of weights are selectively positionable in said weight-receiving enclosures.

* * * * *